US006591829B1

(12) United States Patent
Simon

(10) Patent No.: US 6,591,829 B1
(45) Date of Patent: Jul. 15, 2003

(54) COOL-DOOR OVEN

(75) Inventor: Bordet Simon, Saint Cyr Au Mont d'Or (FR)

(73) Assignee: SIMON, Societe a Responsibilite Limitee (FR)

( * ) Notice: Subject to any disclaimer, the term of this patent is extended or adjusted under 35 U.S.C. 154(b) by 0 days.

(21) Appl. No.: 09/558,463

(22) Filed: Apr. 25, 2000

(30) Foreign Application Priority Data

Apr. 26, 1999 (FR) ..... 99 05419

(51) Int. Cl.[7] ..... A21B 1/00; F24C 15/08

(52) U.S. Cl. ..... 126/19 R; 126/273 R; 126/190; 126/1 F

(58) Field of Search ..... 126/190, 194, 126/198, 273 R, 273.5, 144, 151, 19 R, 1 F; 219/407, 405, 391

(56) References Cited

U.S. PATENT DOCUMENTS 3,121,158 A * 2/1964 Hurko ..... 129/190
3,735,750 A 5/1973 Detterbeck et al. ..... 126/273 R
3,926,177 A 12/1975 Kurek et al. ..... 126/39 B
4,084,571 A * 4/1978 McFarland ..... 126/200
4,149,518 A * 4/1979 Schmidt et al. ..... 126/190
5,433,189 A * 7/1995 Bales et al. ..... 126/190

FOREIGN PATENT DOCUMENTS

FR 2.078.557 11/1971

* cited by examiner

*Primary Examiner*—Henry Bennett
*Assistant Examiner*—Josiah Cocks
(74) *Attorney, Agent, or Firm*—Cantor Colburn LLP

(57) ABSTRACT

The cool-door oven comprises a chamber which has an opening that can be closed by a hinged door.

The chamber is mounted on a chassis with the chamber being insulated with respect to the chassis and the oven door being hinged to the chassis.

Application to ovens intended for cooking food for domestic or communal use.

10 Claims, 2 Drawing Sheets

COOL-DOOR OVEN

TECHNICAL FIELD

The present invention relates to a cool-door oven.

The invention relates more particularly to ovens for domestic use. It may of course also apply to ovens intended for cooking food used in communes. In such ovens, the temperature is about 200 to 250° C. throughout the time that the food is cooking, that is to say sometimes for several hours. An oven of this kind has a door which allows access to the inside of the oven so that the food can be placed therein and removed therefrom. During cooking, the oven door heats up and sometimes reaches temperatures which can cause burning. This door is generally the accessible part of the oven, the other walls or the oven often being built in. To avoid causing burns, it is necessary to avoid heat loss through the oven door.

BACKGROUND OF THE INVENTION

A number of documents disclose oven doors which provide insulation or cooling. Thus, for example, document FR 2 557 272 relates to a door of a cooking appliance comprising a metal frame enclosing two parallel windows spaced apart. Document FR 2 639 097 for its part relates to an oven with a double door. This door consists of a rigid frame which, via guide rods, supports an interior plate which is spring-loaded. Closure is provided by the interior plate which slides with respect to the frame and supports a peripheral sealing gasket.

The various known devices make it possible to have oven door temperatures in the region of 55 to 60° C. after one hour of cooking. Most of these ovens are fitted with glazed doors because one is burnt far less readily on contact with this material than on contact with a metal plate at the same temperature.

The object of the present invention is therefore to provide an oven which has excellent thermal insulation at its door so as to obtain a door which is "cooler" than oven doors of the prior art.

SUMMARY OF THE INVENTION

To this end, the cool-door oven that it proposes is an oven comprising a chamber which has an opening that can be closed by a hinged door.

According to the invention, the chamber is mounted on a chassis with the chamber being insulated with respect to the chassis, and the oven door is hinged to the chassis.

This then yields an oven door which is independent of the oven chamber, also known as the retort. This structure therefore makes it far easier to insulate the exterior face of the oven because the door in an assembly that is independent of the oven retort which is the source of heat.

In a preferred embodiment, the chamber is an insulated chamber with legs, preferably four of these, and these legs are placed on the chassis with the interposition of insulation between the legs and the chassis. Air is therefore used as insulation between the retort and the chassis. The legs are needed to place the retort on the chassis, but attempts are made to reduce the contact between the retort and the chassis to a minimum.

In the conventional way, the door is mounted so that it can pivot about an axle on the chassis. This movement of opening the door is found in most ovens.

To limit heat losses which cause the outside of the oven to heat up, a gasket is advantageously mounted around the periphery of the opening of the chamber and seals between the peripheral edge of this opening and the closed door of the oven.

The invention also provides a structure for the oven door. This structure includes, for example, a frame mounted so that it can pivot on an axle, an outer facade, an interior door lining, and insulating means arranged between the outer facade and the interior lining so that there is no direct contact between the outer facade and the interior lining. This then makes a thermal gap between the internal door lining and the outer facade thereof. In this embodiment, the oven door is, for example, of rectangular overall shape, the door axle is located approximately on one side of the door. The thermal separation between the front facade and the interior lining may then be achieved using a layer of insulating material on the side which has the door axle and by a gasket around the other three sides of the door.

To improve the thermal insulation, a layer of insulating material may be placed between the frame and the outer facade and between the frame and the interior lining.

The oven according to the invention may also have a door handle on the same side as the outer facade and this handle is preferably fixed to the door frame.

When an oven according to the invention has a hob, the hob is only slightly heated by the oven. Thus, the assembly formed by the oven and the hob has a cool front facade when the oven is in operation. It is thus possible to touch the whole of this facade without being burnt. For better insulation of the hob, a deflector may be provided on the front facade between the door and the hob.

Thanks to the good thermal insulation of the retort in an oven according to the invention, this oven makes it possible to save energy when cooking food.

In any event, the invention will be clearly understood with the aid of the description which follows, with reference to the appended diagrammatic drawing, which by way of nonlimiting example depicts one preferred embodiment of an oven according to the invention.

DETAILED DESCRIPTION OF THE PREFERRED EMBODIMENTS

Figure 1:
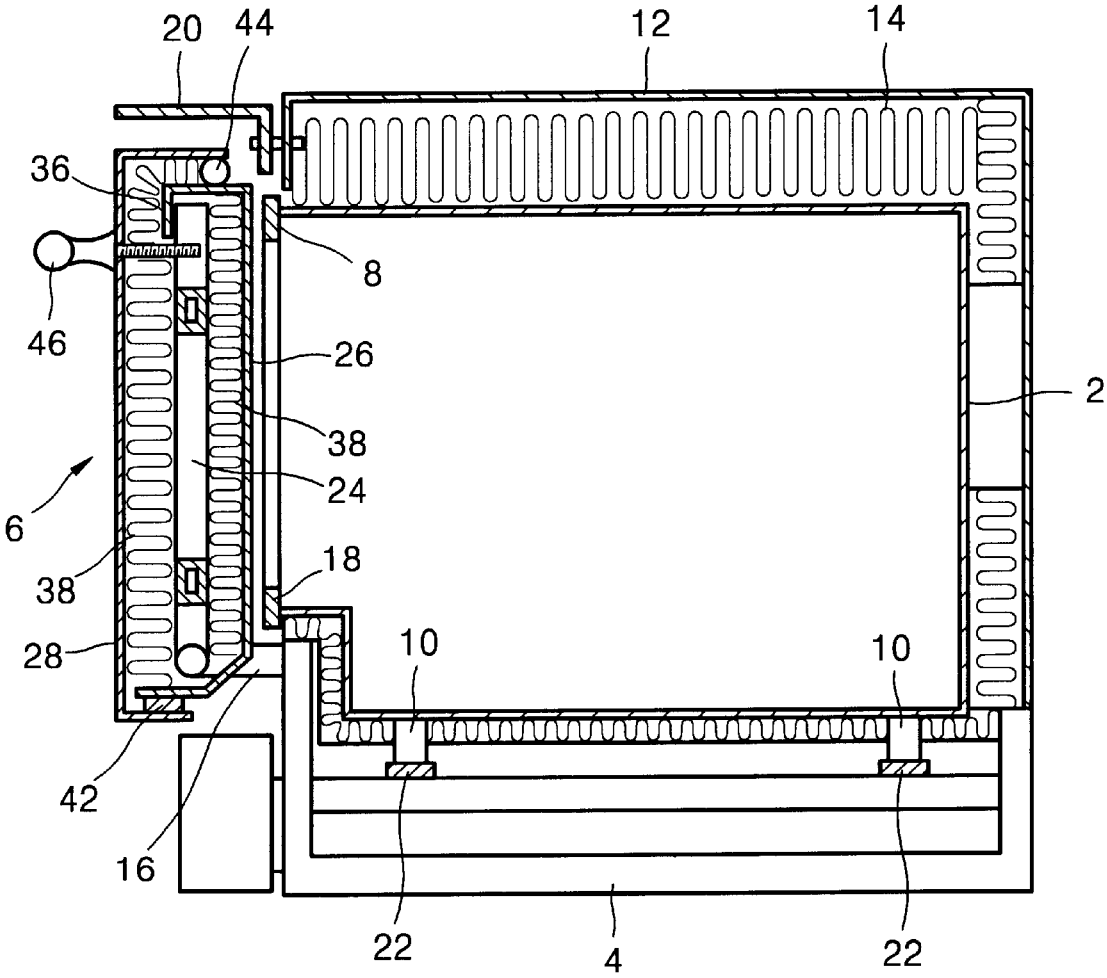
FIG. 1 is a view in longitudinal section of an oven according to the invention.

FIG. 1 is a longitudinal section through an oven according to the invention. This oven comprises a chamber or retort placed on a chassis 4 on which a door 6 is pivotably mounted.

The retort 2 is an oven retort of relatively conventional structure. It is intended, for example, to be heated by a gas burner or by electric heating elements. It has an approximately parallelepipedal shape and one phase of this parallelepiped has an approximately rectangular opening 8. This retort also has four legs 10 (only two of which are visible in FIG. 1) on which the retort 2 rests.

The chassis 4 is a metal structure which bears the retort 2, cladding 12 and an insulating structure 14 placed right around the retort 2, except on its face which has the opening 8.

In the region of the opening 8 of the retort 2, the chassis has, on each side of this opening, toward the bottom, that is to say at the same side as the legs 10, a bearing 16 for the pivot-mounting of the door 6.

The opening 8 has an approximately rectangular flat peripheral edge. A gasket 18 is mounted right along this peripheral edge. It provides sealing between the opening 8 and the door 6.

It may also be seen in FIG. 1 that a guard 20 is fixed over the cladding 12 on the opposite side of the bearing 16. This guard 20 prevents the control knobs located above the oven door from becoming excessively heated. These may be control knobs for the oven but may also be controls for a hob associated with this oven.

Between the chassis 4 and the legs 10 of the retort 2 are pads 22 made of an insulating material. These pads prevent the heat produced in the retort 2 from being conducted toward the chassis 4.

Figure 2:
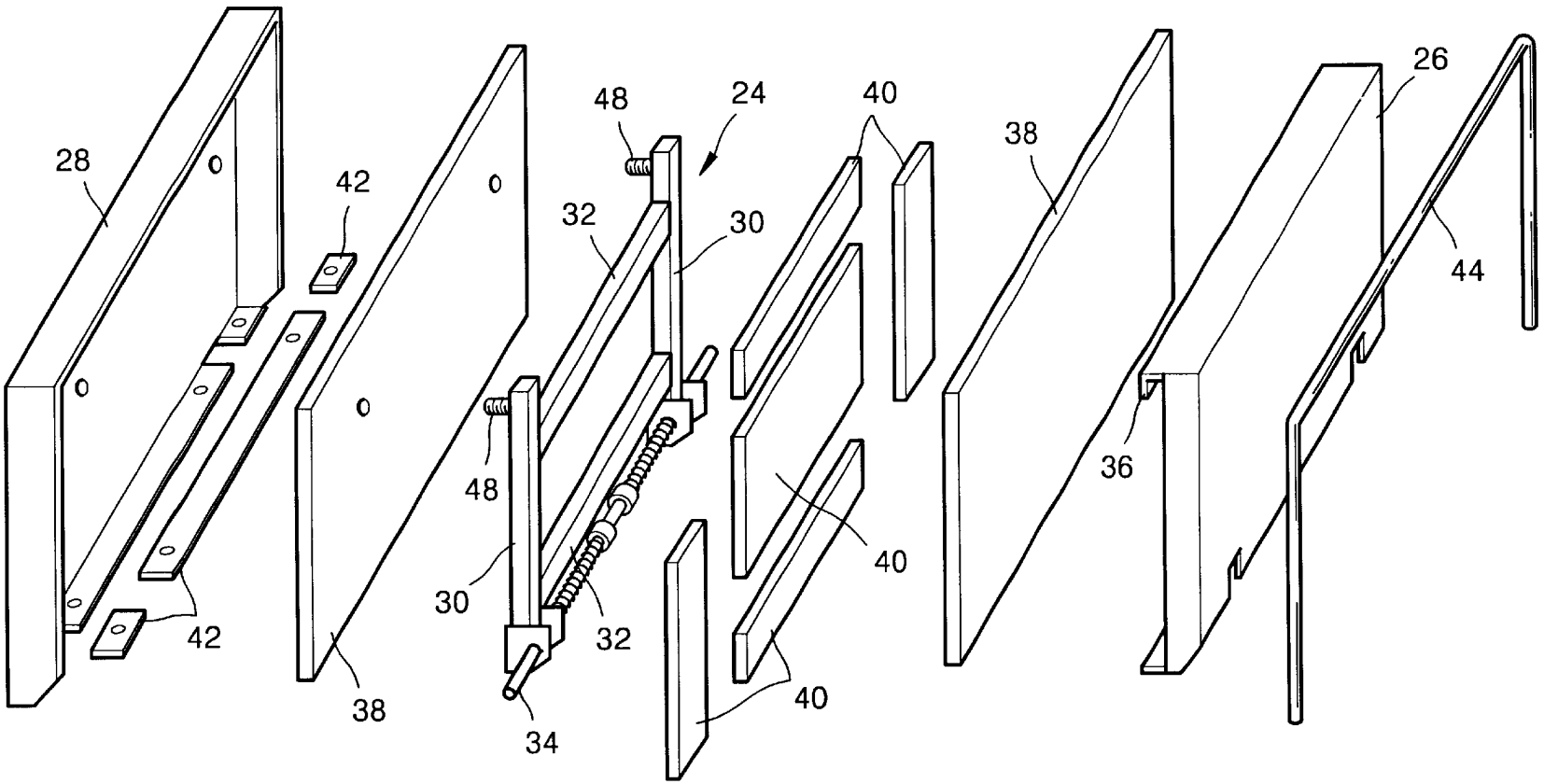
FIG. 2 is an exploded perspective view of the door of this oven.

FIG. 2 shows the structure of the door 6 in detail. This door comprises, in particular, a frame 24, an interior lining 26 and an outer facade 28.

The interior lining 26 and the outer facade 28 are sheet metal plates, the four edges of which have been bent over. As can be seen in FIG. 1, the dimensions of the interior lining 26 are such that this lining can fit into the outer facade 28 with clearance.

The frame 24 is formed of four metal tubes: two vertical tubes 30 connected by two horizontal tubes 32. The lower end of the vertical tubes carries an axle 34. The latter is intended to collaborate with the bearing 16 of the chassis 4 to allow the door to be mounted so that it can pivot between a closed position in which the lining 26 is pressed against the gasket 18 and in which the opening 8 is thus closed, and an open position in which it is pivoted through about 90° with respect to the closed position.

The door is mounted as follows. The interior lining 26 is fitted on the frame 24. The interior lining 26 is designed with a rim 36 to hold the latter on the frame. A sheet 38 of insulating material is placed between the frame 24 and the interior lining 26. The space left empty between the vertical tubes 30, horizontal tubes 32 and edges of the interior lining 26 are filled with pieces 40 of insulating material. On the same side as the axis 34, the edge of the interior lining 26 is protected by pieces 42 of insulating material. On the other three outer faces of the edges of the interior lining 26 is a gasket 44. Thus, there is a thermal barrier made of an insulating material right around the interior lining 26. A second insulating sheet 38 then covers the frame 24 and the front faces 28 of the door is placed on this mounted assembly, like a lid. Assembly screws, not depicted, hold this "lid" on this assembly.

The door 6 also has a handle 46. This handle is fixed to the frame 24. The latter has threaded rods 48 which, in the mounted position, pass through an insulating sheet 38 and the outer facade 28. The handle 46 is thus mounted on these two threaded rods 48.

This door 6, thus assembled, is mounted on the two bearings 16 of the chasses 4 in the conventional way.

This then achieves very good insulation of the oven, particularly in the region of its door 6. The outer facade 28 is very well insulating from the retort 2. This is because there is no direct contact between the interior lining 26 and the outer facade 20. A thermal break is achieved between this lining 26 and the facade 20.

What is more, the fact that the door is not mounted directly on the retort 2 but on a chassis which is itself insulated from the retort, makes it possible to limit the extent to which the door heats up.

Finally, the oven door handle 46 heats up very little while the oven is operating. This is because it is mounted on the frame 24 of the door 6 which is itself well insulated from the retort.

Between this frame and the retort there are a sheet of insulation 38 and the interior lining 26. What is more, as mentioned hereinabove, this frame is not mounted directly on the retort but is mounted on the chassis which is insulated from the retort.

By virtue of the good insulation of the structure of the oven, the door thereof remains "cool" even during operation. It is possible for the door temperature not to exceed 45° C. If this oven has a hob, the front face thereof may also remain cool. The assembly formed by the oven and the hob therefore has a front facade which remains entirely cool, without the risk of causing burns if touched by a hand.

In addition, the good thermal insulation makes it possible to increase the efficiency of the retort and therefore make energy savings.

As goes without saying, the invention is not restricted to the preferred embodiment described hereinabove by way of nonlimiting example; on the contrary, it encompasses all alternative forms thereof which fall within the scope of the claims hereinafter.

Thus, the structure of the oven door could differ from that described hereinabove without departing from the scope of the invention.

Likewise, the insulation between the retort and the chassis is achieved insofar as the retort has legs and these legs rest on the chassis by insulating pads. Some other form of insulation between the retort and the chassis could be envisaged.

What is claimed is:

1. A cool-door oven comprising:

a chassis;

a chamber which has an opening and which is mounted on the chassis;

a first heat insulating means interposed between the chamber and the chassis; and a door hinged to the chassis for closing the opening of the chamber comprising a frame mounted so that it can pivot on an axle, an outer facade, an interior door lining, a second heat insulating means arranged between the outer facade and the interior lining so that there is no direct contact between the outer facade and the interior lining, a layer of insulating material between the frame and the outer facade, and a layer of insulating material between the frame and the interior lining;

wherein the chamber comprises legs placed on the chassis with an interposition of the first heat insulating means between the legs and the chassis, and pads made of an insulating material being placed between the chassis and the legs.

2. The cool-door oven according to claim 1, wherein the door is mounted so that it can pivot about an axle on the chassis.

3. The cool-door oven according to claim 1, further comprising a seal which is fitted around a periphery of the opening of the chamber and seals between the peripheral edge of the opening and the door of the oven when the door is closed.

4. The cool-door oven according to claim 1, wherein the oven door is of rectangular overall shape, the door axle is located approximately on one side of the door, and the outer facade and the interior lining are thermally separated.

5. The cool-door oven according to claim 1, wherein the door further comprises a door handle fixed to the door frame on the same side as the outer facade.

6. The cool-door oven according to claim 4, wherein the thermal separation of the front facade and the interior lining is achieved by a layer of insulating material on the side which has the door axle, and by a gasket around the other three sides of the door.

7. The cool-door oven according to claim 1, wherein the chamber comprises four legs.

8. The cool-door oven according to claim 1, wherein the chamber is heat insulated.

9. The cool-door oven according to claim 1, wherein there is no direct contact or thermal bridge between the chassis and the chamber.

10. The cool-door oven according to claim 9, further comprising a seal which is fitted around a periphery of the opening of the chamber and seals between the peripheral edge of the opening and the door of the oven when the door is closed.

* * * * *